United States Patent [19]

Timmons

[11] 4,144,593

[45] Mar. 20, 1979

[54] FASHIONABLE NURSING GARMENT

[76] Inventor: Suzanne D. Timmons, 7633 Chadwick, Prairie Village, Kans. 66208

[21] Appl. No.: 817,978

[22] Filed: Jul. 22, 1977

[51] Int. Cl.[2] ..... A41D 1/20

[52] U.S. Cl. ..... 2/104

[58] Field of Search ..... 2/104, 105, 267, 74, 2/70, 119; 128/478, 479, 481, 460, 461

[56] References Cited

U.S. PATENT DOCUMENTS

| | | | |
|---|---|---|---|
| 1,206,480 | 11/1916 | Stagg | 2/104 |
| 2,585,142 | 2/1952 | Levitt | 2/105 |
| 2,620,476 | 12/1952 | Kelsall | 2/105 |

FOREIGN PATENT DOCUMENTS

| | | | |
|---|---|---|---|
| 509510 | 11/1920 | France | 2/119 |
| 1474127 | 2/1967 | France | 2/74 |

*Primary Examiner*—Doris L. Troutman

*Attorney, Agent, or Firm*—Schmidt, Johnson, Hovey & Williams

[57] ABSTRACT

The invention may be embodied in a finely styled, fashionable dress, nightgown, blouse, jumpsuit or other article of clothing without sacrificing functionality, convenience or modesty. A single large front panel hinged generally at the top of the garment covers an open breast area in the frontpiece of the bodice so that when buttons, ties or other fasteners are released along the bottom and sides of the panel, the baby may be inserted up and under the loosened panel to nurse without exposing the woman's breasts.

9 Claims, 7 Drawing Figures

FASHIONABLE NURSING GARMENT

This invention relates to wearing apparel, and, more particularly, to a woman's nursing garment that incorporates important functional features without detracting from styling or aesthetic considerations.

Nursing garments per se are quite old in the art, but none has apparently been totally commercially acceptable, owing at least in part to the fact that none has been able to satisfactorily accommodate the conflicting factors of functionality on the one hand, and styling or fashion on the other. Additionally, prior garments have typically been unable to provide the wearer with the confidence that her modesty would not be jeopardized when nursing, such garments being unable to permit the mother to both nurse and keep her breasts substantially fully covered at the same time.

Accordingly, one important object of the present invention is to provide a nursing garment that may take on any one of countless attractive styles and be embodied in any number of different types of wearing apparel without inhibiting the freedom of the woman to nurse as frequently as may be required and without removing the garment.

An additional important object of this invention is to achieve the foregoing object, but with the additional benefit of giving the wearer the peace of mind that she may nurse her baby without risking exposure of her breasts.

A further important object of the invention is to obtain the foregoing objects while making it a relatively simple matter for the woman to prepare the garment for nursing and to return the same to its normal condition upon completion of nursing.

Other important considerations and features include providing a way of substantially covering a baby while nursing so as to eliminate the need for additional blankets and the like around the baby; retaining the woman's body heat to avoid exposure to cold, ambient temperatures during winter months; and providing the convenience of having both breasts prepared for successive nursing through only one initial preparational procedure. In the drawings.

Figure 1:
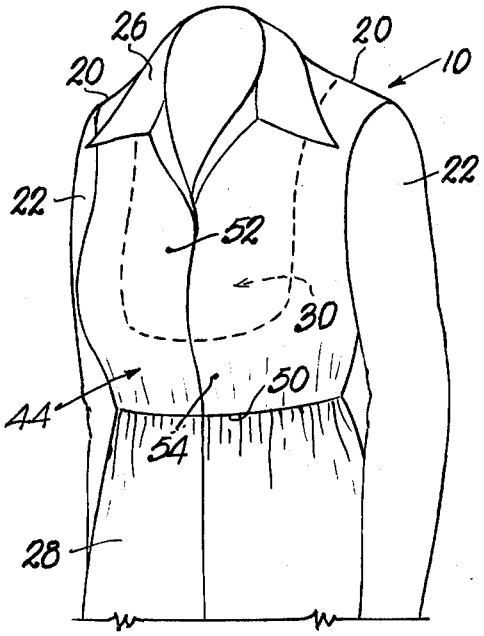
FIG. 1 is a fragmentary front perspective view of a garment incorporating the principles of the present invention.
Figure 2:
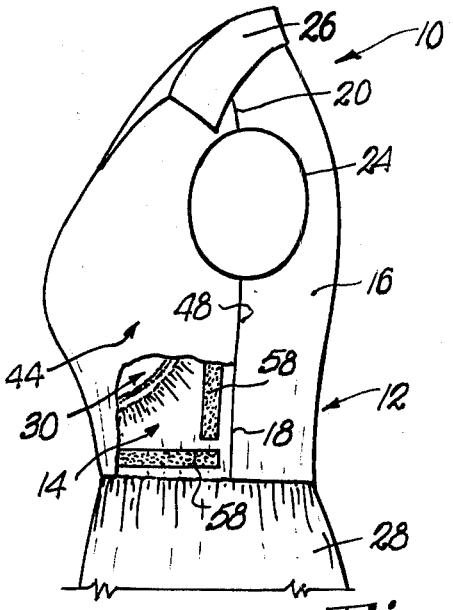
FIG. 2 is a left side elevational view thereof with a sleeve removed for clarity and a portion of the front panel broken away to reveal details of construction.
Figure 3:
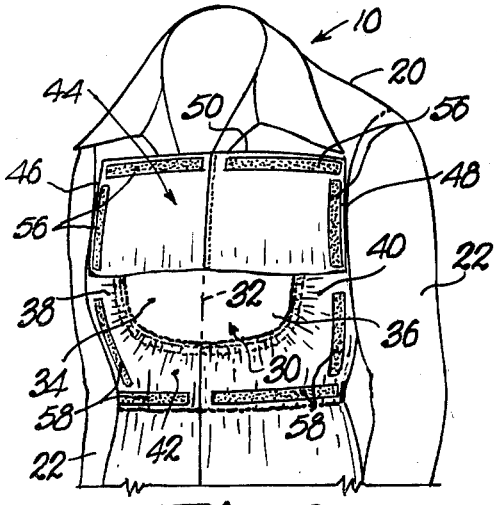
FIG. 3 is a front perspective view of the garment as in FIG. 1, but with the front panel lifted to reveal details of construction.

The garment 10 of FIGS. 1–3 is illustrated as taking the form of a dress, although it is to be understood and will become apparent that the principles of this invention are not limited to any one specific type of women's apparel and, indeed, may be embodied in many different types of dresses, gowns, jumpsuits and the like. The garment 10 has a bodice 12 intended to extend generally from the neck of the wearer to the waist thereof and comprising a front-piece 14 that is normally hidden from view and a backpiece 16 that is normally exposed. The frontpiece 14 and the backpiece 16 are connected together along their marginal extremities, such as side seams 18 (only one being shown) and shoulder seams 20, so as to give the bodice 12 an overall tubular configuration that enables it to receive the upper portion of the woman's body during use. The bodice 12 may, of course, be provided with sleeves 22 in communication with armholes 24 (only one being shown) in the bodice 12. Similarly, the bodice 12 may be provided with any type of collar 26, skirt 28, or pantlegs (not shown).

The frontpiece 14 has opening means therein in the form of a large opening 30 disposed symmetrically with respect to a medial axis 32 extending vertically from the waist to the collar 26 so that a pair of open areas 34 and 36 on opposite sides of the axis 32 are located in position for the woman's breasts to project therethrough. Although the open areas 34 and 36 are illustrated herein as intersecting one another along the axis 32 so as to present the opening means in the form of a single large opening 30, it is to be understood that it is within the scope of the present invention to separate the open areas 34 and 36 by a central vertically extending strip (not shown) along the axis 32 if desired.

The frontpiece 14 is illustrated by way of example as being generally U-shaped, having a pair of opposite side stretches 38 and 40 extending upwardly from the waist along the side seams 18 and separated by the opening 30. Furthermore, a transverse stretch 42 of the frontpiece 14 extends between and interconnects the side pieces 38, 40 generally below the opening 30 and slightly above the waist. If desired, the frontpiece 14 may be rendered generally box-shaped by the addition of a second transverse stretch (not shown) interconnecting stretches 38, 40 above the opening 30. The side stretches 38, 40 extend upwardly from the waist, around the armholes 24, and terminate along the shoulder seams 20.

A single panel 44 (shown flipped up in FIG. 3) is common to both opening areas 34, 36, covering the entire opening 30. The panel 44 extends transversely of the axis 32 in opposite directions therefrom across the frontpiece 14 and terminates in a pair of laterally extreme side edges 46 and 48 that are disposed beyond the areas 34, 36 when the panel 44 is fully closed, as illustrated in FIGS. 1 and 2. A lower edge 50 of the panel 44 interconnects the side edges 46, 48 and is disposed below the areas 34, 36 when the panel 44 is closed. If desired, the panel 44 may be constructed in two parts, e.g., side-by-side parts 52 and 54 fastened down the front by any suitable fastening means (not illustrated), all as may be required or desirable in accordance with styling trends and other considerations.

The panel 44 is attached generally along the top thereof to the bodice 12 in a hingedly suspended manner so that the lower edge 50 and side edges 46, 48 thereof may be swung a short distance outwardly away from the frontpiece 14 when it is time to nurse. The specific means for accomplishing such attachment and the length of the panel 44 that is to swing may vary, it being necessary only that the lower portion of the panel 44 be swung outwardly a sufficient distance to permit the nursing baby to be inserted up under the panel 44, between the latter and the frontpiece 14. In FIGS. 1–3, the panel 44, while extending the full length of the bodice 12 from the waist to the shoulder seams 20, is nonetheless so affixed to the frontpiece 14 that only that portion of the panel 44 below the bustline swings outwardly while the upper portion along the shoulder seams 20 and the armholes 24 remain in place. It is to be understood, however, that the panel 44 could swing more completely, such as would be the case if it were hingedly attached only along the shoulder seams 20 or neckline and not also along the seams around the armholes 24. Regardless of the selected manner of swinging, it is important to note that the transverse dimensions of the panel 44 are such that those portions of the side edges 46, 48 below the bustline wrap under and are disposed below the armholes 24 so as to substantially overlap the side stretches 38, 30 of the frontpiece 14. Similarly, the lower edge 50 of the panel 44 is disposed sufficiently far enough below the bustline to substantially overlap the transverse stretch 42 of the front-piece 14.

The panel 44 may be held in its fully closed position, as illustrated in FIGS. 1 and 2, by any number of means, such as, for example, buttons, zippers, ties, snaps and other fasteners. An additional example is illustrated in FIGS. 2 and 3 wherein the edges of the panel 44 and corresponding regions of the frontpiece 14 are provided with mating strips 56 and 58 respectively, of hook and eye curly pile material sold under the trademark "VELCRO." The strips 56, 58 provide a secure way of holding the panel 44 in place when nursing is not desired, and yet, such holding force can easily be overcome by simply stripping the panel 44 loose from the frontpiece 14 when it is time to nurse.

Figure 4:
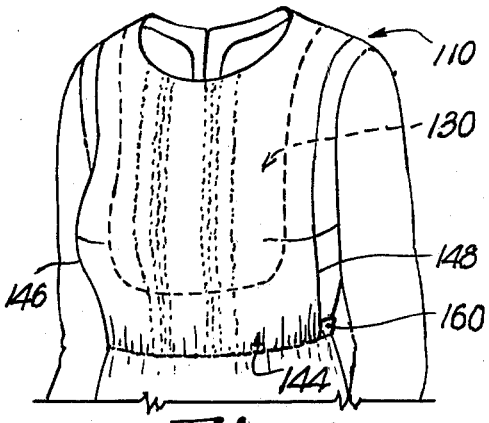
FIG. 4 is a fragmentary, front perspective view of a second garment embodying the principles of the present invention.
Figure 5:
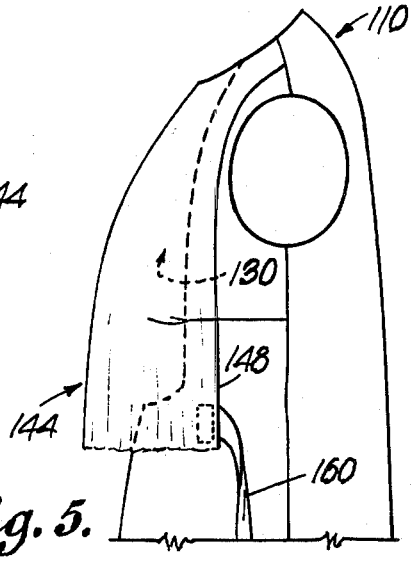
FIG. 5 is a left side elevational view thereof with a sleeve removed and illustrating the manner in which the panel may simply hang loosely from the bodice during nursing.

An alternative embodiment is illustrated in FIGS. 4 and 5 wherein the garment 110 is illustrated in the form of a nightgown. The principles of construction are similar to those for the garment 10, with the exception that the front panel 144 covering opening 130 has side edges 146 and 148 that do not extend back underneath the armholes (not shown) of the gown 110. Moreover, side margins of panel 144 are not sewn into the armhole seams and the means selected to hold the panel 144 in its closed position takes the form of a two-part strap or belt 160 that may be tied at the back.

Figure 6:
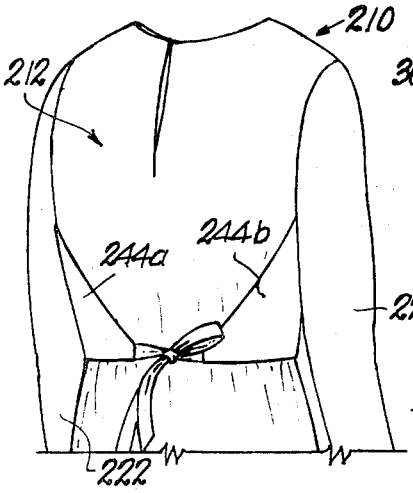
FIG. 6 is a rear perspective view of a third form of garment employing my invention wherein wide, wrap-around extensions of the front panel are used.

FIG. 6 shows another alternative arrangement in which the gown 210 has wide extensions **244*a* and 244*b* on its front panel that wrap around the bodice 212 beneath the sleeves 222 for additional security against exposure during nursing. Extensions 244*a* and 244*b*** may tie at the back if desired.

Figure 7:
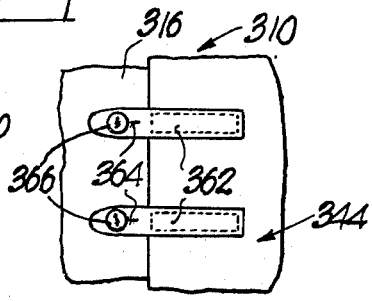
FIG. 7 is a fragmentary detail view of one alternative means for releasably fastening the front panel against the bodice between nursing intervals.

FIG. 7 illustrates yet another garment 310 in which the front panel 344 is held in place by tabs 362 that overlap the backpiece 316 and have eyelets 364 that receive buttons 366.

The manner of preparing any of the above-described garments for nursing and then subsequently returning things to their initial condition should be readily apparent from the foregoing detailed description. Using the dress 10 as an example, note that when the panel 44 is securely held in place by the strips 56 and 58, the outward appearance is such that no clue is given that the dress 10 is especially conducive to breast feeding. With any attachment points for the panel 44 being disposed along the shoulder seams 20 or the seams surrounding the armholes 24, and with the side edges 46 and 48 of the panel 44 being located below the armholes 24 and normally covered by the sleeves 22, the dress 10 will appear to all concerned to be simply an attractive piece of apparel entirely in step with contemporary styles and fashion trends.

When it is time to nurse, the woman need only loosen the panel 44 from the frontpiece 14 along the strips 56, 58 and then allow the panel 44 to hang freely from its points of connection to the frontpiece 14 in the manner illustrated by the panel 144 in FIG. 5. This allows the woman to slip the baby up underneath the panel 44, while the latter continues to hang loose, so that the baby can gain access to the mother's breasts in the opening 30.

It is most important to recognize that the panel 44 need not be flipped up or folded back, such being illustrated in FIG. 3 only to reveal details of construction. By virtue of the fact that the panel 44 extends clear across the area normally occupied by both breasts, and by virtue further of the fact that it is hinged at the "top" rather than along the bottom, the breasts need not be uncovered for nursing, it being necessary only to provide for access thereto by the baby. This is accomplished quite sufficiently by the space created between the panel 44 and the frontpiece 14 when panel 44 is loosened along its edges 46, 48 and 50. Note further that because of the substantial overlapping nature of the panel 44 with the stretches 38, 40 and 42 of the frontpiece 14, little opportunity for exposure is created.

As a result of this special construction, a number of distinct and quite significant advantages are achieved. First, in addition to the blending of both style and function in a garment of the character described, the modesty of the mother is, of course, well preserved and peace of mind is promoted because her breasts need not be exposed during feeding.

Moreover, note that depending on where the panel 44 hinges, i.e., along the shoulder seams 20, the neckline, or lower at the bustline or armholes, the panel 44 may be of such size as to allow the baby to be covered for warmth during nursing. Further, the fact that the baby is between the panel 44 and the mother's body permits the baby to gain the advantage of the mother's own body heat at such time.

Additionally, the mother herself is prevented from getting chilled during nursing because her breasts remain fully covered throughout the nursing procedure, a factor that can be quite significant in winter. This is especially true in the instance where the principles of the present invention are incorporated into a long nightgown such as illustrated in FIGS. 4, 5 and 6, wherein without the special front panel it would be necessary for the mother to shed her gown, lower the top of the gown or raise the skirt portion thereof sufficiently to expose her breasts. Substantial body heat could be lost in those circumstances, to the detriment of both the mother and the baby.

An additional attribute lies in the convenience that is afforded by the fact that a single panel 44 covers both breasts. It is normally the practice for babies to nurse from both breasts in succession and, therefore, by making one initial preparation, i.e., by loosening the panel 44 initially, conditions are set for nursing to be carried out on both breasts without additional manipulation of the garment being required.

When nursing has been completed, it is only necessary to press the panel 44 against the frontpiece 14 along edges 46, 48 and 50 so as to interlock the strips 56 and 58. Thereupon, the panel 44 will be returned to the initial condition illustrated in FIGS. 1 and 2.

As is apparent, all of the foregoing attributes apply equally as well to the embodiments of FIGS. 4–7, it being necessary in the embodiment of FIGS. 4 and 5 to simply untie the straps 160 and allow the panel 144 to hang loosely as in FIG. 5 when it is time to nurse. Simply retying the straps 160 will once again return the panel 144 to its original condition.

Similarly, untying the extensions 244*a* and 244*b* in FIG. 6 readies the gown 210 for nursing, and by keeping the loose extensions 244*a* and 244*b* under sleeves 222, no side exposure is possible. Retying returns gown 210 to its initial condition.

Alternatively, removing the tabs 362 of FIG. 7 from the buttons 366 through the eyelets 364 will place the garment in condition for nursing, while a rebuttoning will once again return things to their initial condition.

Having thus described the invention, what is claimed as new and desired to be secured by Letters Patent is:

1. A nursing garment comprising:

a bodice having a frontpiece and a backpiece joined together along marginal extremities thereof in a manner for receiving the upper portion of a woman's body generally from her neck to her waist, said frontpiece having a medial, normally generally vertically extending axis;

said frontpiece further having opening means therein disposed symmetrically with respect to said axis and including an open area on each of the two opposite sides of said axis and through which the woman's breasts may project;

a single panel common to said two areas and covering the same in outwardly disposed relationship to said frontpiece for shielding the breasts from public view, said panel extending transversely of said axis and in opposite directions therefrom across the frontpiece and terminating in a pair of laterally extreme side edges beyond said areas, said panel having a lower edge disposed below said areas and interconnecting said two side edges;

attaching means hingedly suspending said panel from the bodice for swinging movement of said lower edge and said side edges of the panel outwardly away from said frontpiece a sufficient distance to provide access to the breasts for nursing without substantially exposing the same; and selectively releasable fastening means for holding said panel in said covering relationship against said outward swinging movement, said frontpiece having a pair of laterally spaced side stretches separated by said opening means and overlapped by said panel, said frontpiece further having a transverse stretch interconnecting said side stretches below said opening means, said bodice further including means defining a pair of armholes, said side edges of the panel having portions thereof disposed below and at least as far rearwardly from said axis as said armholes when the panel is held in said covering relationship by said fastening means.

2. A nursing garment as claimed in claim 1, wherein said two open areas intersect one another along said axis to form a single opening common to both breasts.

3. A nursing garment as claimed in claim 1, wherein said attaching means comprises seam means between the panel and said frontpiece.

4. A nursing garment as claimed in claim 1, wherein said panel includes a pair of laterally adjacent parts; and means detachably joining said parts together for swinging in unison.

5. A nursing garment as claimed in claim 1, wherein said panel portions have rearward extensions thereon disposed to wrap around the bodice below said armholes.

6. A nursing garment as claimed in claim 1, wherein said fastening means comprises mating strips of curly pile loop and hook fastener material along said edges of the panel and on said bodice.

7. A nursing garment as claimed in claim 1, wherein said fastening means comprises strap means wrappable around the woman's waist.

8. A nursing garment as claimed in claim 1, wherein said fastening means comprises mating button and eyelet means between the panel and the bodice.

9. A nursing garment as claimed in claim 1, wherein said bodice is further provided with a pair of armholes, said side stretches extending from said opening means below the armholes and at least as far rearwardly as said armholes.

* * * * *